US007458176B1

(12) United States Patent
Schnabel

(10) Patent No.: US 7,458,176 B1
(45) Date of Patent: Dec. 2, 2008

(54) CONSTRUCTION ZONE SIGN COVER

(76) Inventor: Kurt Robert Schnabel, 1151 Stonehaven Ave., Broomfield, CO (US) 80020

( * ) Notice: Subject to any disclaimer, the term of this patent is extended or adjusted under 35 U.S.C. 154(b) by 0 days.

(21) Appl. No.: 11/973,823

(22) Filed: Oct. 10, 2007

Related U.S. Application Data

(60) Provisional application No. 60/883,997, filed on Jan. 8, 2007.

(51) Int. Cl.
*G09F 7/00* (2006.01)

(52) U.S. Cl. ..... 40/612; 40/611.11; 40/611.12; 160/368.1

(58) Field of Classification Search ..... 40/612, 40/611.01, 611.11, 611.12, 603, 491; 160/10, 160/368.1; 150/154
See application file for complete search history.

(56) References Cited

U.S. PATENT DOCUMENTS

| | | | | | |
|---|---|---|---|---|---|
| 1,713,632 | A | * | 5/1929 | Wall | 40/603 |
| 1,974,076 | A | * | 9/1934 | Lindenberger | 40/603 |
| 3,058,246 | A | * | 10/1962 | Schoeffier | 40/606.13 |
| 3,185,197 | A | | 5/1965 | Spiro et al. | |
| 3,202,193 | A | | 8/1965 | Ware | |
| 4,793,082 | A | * | 12/1988 | Petrick et al. | 40/617 |
| 4,959,916 | A | * | 10/1990 | Cochrane | 40/603 |
| 4,999,938 | A | * | 3/1991 | Behling | 40/610 |
| 5,218,775 | A | | 6/1993 | Singer | |
| 5,715,881 | A | | 2/1998 | Ruskamp et al. | |
| 6,023,867 | A | | 2/2000 | Gagne | |
| 6,148,555 | A | | 11/2000 | Beauchamp et al. | |
| 6,209,598 | B1 | | 4/2001 | Petrey | |
| 6,308,447 | B1 | * | 10/2001 | Tress | 40/607.03 |
| D509,544 | S | * | 9/2005 | Nickels | D20/99 |
| 7,043,861 | B1 | * | 5/2006 | Crawford | 40/611.11 |
| 7,062,872 | B2 | * | 6/2006 | Williams et al. | 40/586 |
| 7,086,189 | B2 | * | 8/2006 | Morris et al. | 40/606.03 |

FOREIGN PATENT DOCUMENTS

| | | |
|---|---|---|
| DE | 8904256 | 5/1989 |
| EP | 0 992 968 | 10/1999 |
| FR | 2 516 565 | 11/1981 |
| FR | 2 881 260 | 1/2005 |
| JP | 2003-96722 | 9/2001 |

* cited by examiner

*Primary Examiner*—Gary C Hoge
(74) *Attorney, Agent, or Firm*—Emery L. Tracy

(57) ABSTRACT

A construction zone sign cover for covering a highway and/or roadway sign during construction or other events is provided. The sign has a top edge and a bottom edge. The sign cover comprises a first sign portion having a first side surface, a second side surface, first side edge, a second side edge, a top edge, and a bottom edge and a second sign portion having a first side surface, a second side surface, a first side edge, a second side edge, a top edge, and a bottom edge. A connecting mechanism slidably connects the first sign portion to the second sign portion. A biasing mechanism biases the first sign portion and the second sign portion in a general direction toward each other. A first securing mechanism releasably secures the top edge of the first sign portion to the top edge of the sign. A second securing mechanism releasably secures the bottom edge of the second sign portion to the bottom edge of the sign.

20 Claims, 5 Drawing Sheets

CONSTRUCTION ZONE SIGN COVER

The present application claims benefit of priority of pending provisional patent application Ser. No. 60/883,997, filed on Jan. 8, 2007, entitled "Construction Zone Sign Covers".

BACKGROUND OF THE INVENTION

1. Field of the Invention

This invention relates generally to construction zone sign cover and, more particularly, the invention relates to construction zone sign cover for covering highway and roadway signs in construction zones which are uniform, durable, reusable, and easy to install.

2. Description of the Prior Art

Road signs convey important information to the driving public every day. Road sign insignia can indicate speed limits, exits, services and other messages helpful to drivers. Unfortunately, not all road signs communicate accurate or pertinent information. Events such as road repairs, improvements, and/or repaving projects often render a sign's message irrelevant or invalid due to the construction activity. The construction activity dictates the sign's removal or concealment until the activity is finished.

Road construction crews typically remove road signs during construction projects scheduled to last for a year or more. For construction projects scheduled to last for a few months, road crews typically just cover road signs rather than incur the added expense of removing or changing the inappropriate sign. Unfortunately, a majority of the concealment schemes employed by construction crews are difficult to install or remove or are ineffective or destructive to the sign.

One popular method of covering a traffic sign is to hang a sheet of plywood to the insignia side of the sign with specially manufactured clips to mount the plywood to the sign. Plywood can be quite heavy and bulky and bolts disfigure the sign when driven through both the plywood and the sign's sheet metal face. Workers must lift the heavy plywood in place and secure the bolt or bolts in place with a nut and washer combination on the backside of the sign. Initially, bolted plywood may effectively conceal the sign, but plywood, when exposed to the weather tends to warp and crack. Untreated plywood is also prone to decay and rot. Warped, cracked or rotted plywood may eventually break free of the bolts and detach from the sign. In addition to plywood's vulnerability to weather, it is a considerably dense material requiring several crewmembers to attach the wood to the sign. Injuries from hanging these burdensome sheets are quite common.

Strapping similar sized signs to the insignia side of a traffic sign is another method of concealing a sign. The method entails securing the insignia side of a similar sized sign to the insignia side of the traffic sign so that only the blank sheet metal side of each is showing. This procedure typically injures the traffic sign to be covered. While this procedure may employ the use of a more durable material than wood, the procedure is also twice as destructive, more expensive, and harder to install since it weighs upwards of seventy pounds.

Other less expensive and less permanent measures have been utilized in an attempt to cover up the insignia side of a sign. Plastic or burlap bags can be placed over the signs. To hold the bags in place workers often use an industrial tape such as duct tape. Such measures rarely last as the elements quickly tear away at the plastic or burlap covering. Soon only a partially shrouded sign and duct tape is all that is left of the sign covering after a few weeks.

SUMMARY

The present invention is a construction zone sign cover for covering a highway and/or roadway sign during construction or other events. The sign has a top edge and a bottom edge. The sign cover comprises a first sign portion having a first side surface, a second side surface, first side edge, a second side edge, a top edge, and a bottom edge. A substantially U-shaped first rail is mounted to the first side surface of the first sign portion adjacent the first side edge and a substantially U-shaped second rail is mounted to the first side surface of the first sign portion adjacent the second side edge. A second sign portion is provided having a first side surface, a second side surface, a first side edge, a second side edge, a top edge, and a bottom edge. The first side edge of the second sign portion is receivable within the first rail and the second side edge of the second sign portion is receivable within the second rail such that the first sign portion is slidably mounted to the second sign portion with the second side surface of the first sign portion overlapping the first side surface of the second sign portion. A first spring mechanism is secured between the first sign portion and the second sign portion along the first edges of the first sign portion and the second sign portion. A second spring mechanism is secured between the first sign portion and the second sign portion along the second edges of the first sign portion and the second sign portion with the first spring mechanism and the second spring mechanism biasing the first sign portion and the second sign portion in a general direction toward each other. At least one first hanging rail is mounted to the second side surface of the first sign portion adjacent the top edge of the first sign portion, the top edge of the sign releasably receivable within the first hanging rail and at least one second hanging rail is mounted to the second side surface of the second sign portion adjacent the bottom edge of the second sign portion, the bottom edge of the sign releasably receivable within the second hanging rail.

In addition, the present invention includes a construction zone sign cover for covering a highway and/or roadway sign during construction or other events. The sign has a top edge and a bottom edge. The sign cover comprises a first sign portion having a first side surface, a second side surface, first side edge, a second side edge, a top edge, and a bottom edge and a second sign portion having a first side surface, a second side surface, a first side edge, a second side edge, a top edge, and a bottom edge. A connecting mechanism slidably connects the first sign portion to the second sign portion. A biasing mechanism biases the first sign portion and the second sign portion in a general direction toward each other. A first securing mechanism releasably secures the top edge of the first sign portion to the top edge of the sign. A second securing mechanism releasably secures the bottom edge of the second sign portion to the bottom edge of the sign.

The present invention further includes a method for covering a highway and/or roadway sign during construction or other events with the sign having a top edge and a bottom edge. The method comprises providing a first sign portion having a first side surface, a second side surface, first side edge, a second side edge, a top edge, and a bottom edge, providing a second sign portion having a first side surface, a second side surface, a first side edge, a second side edge, a top edge, and a bottom edge, slidably connecting the first sign portion to the second sign portion, biasing the first sign portion and the second sign portion in a general direction toward each other, releasably securing the top edge of the first sign portion to the top edge of the sign, and releasably securing the bottom edge of the second sign portion to the bottom edge of the sign.

DETAILED DESCRIPTION OF THE PREFERRED EMBODIMENTS

Figure 1:
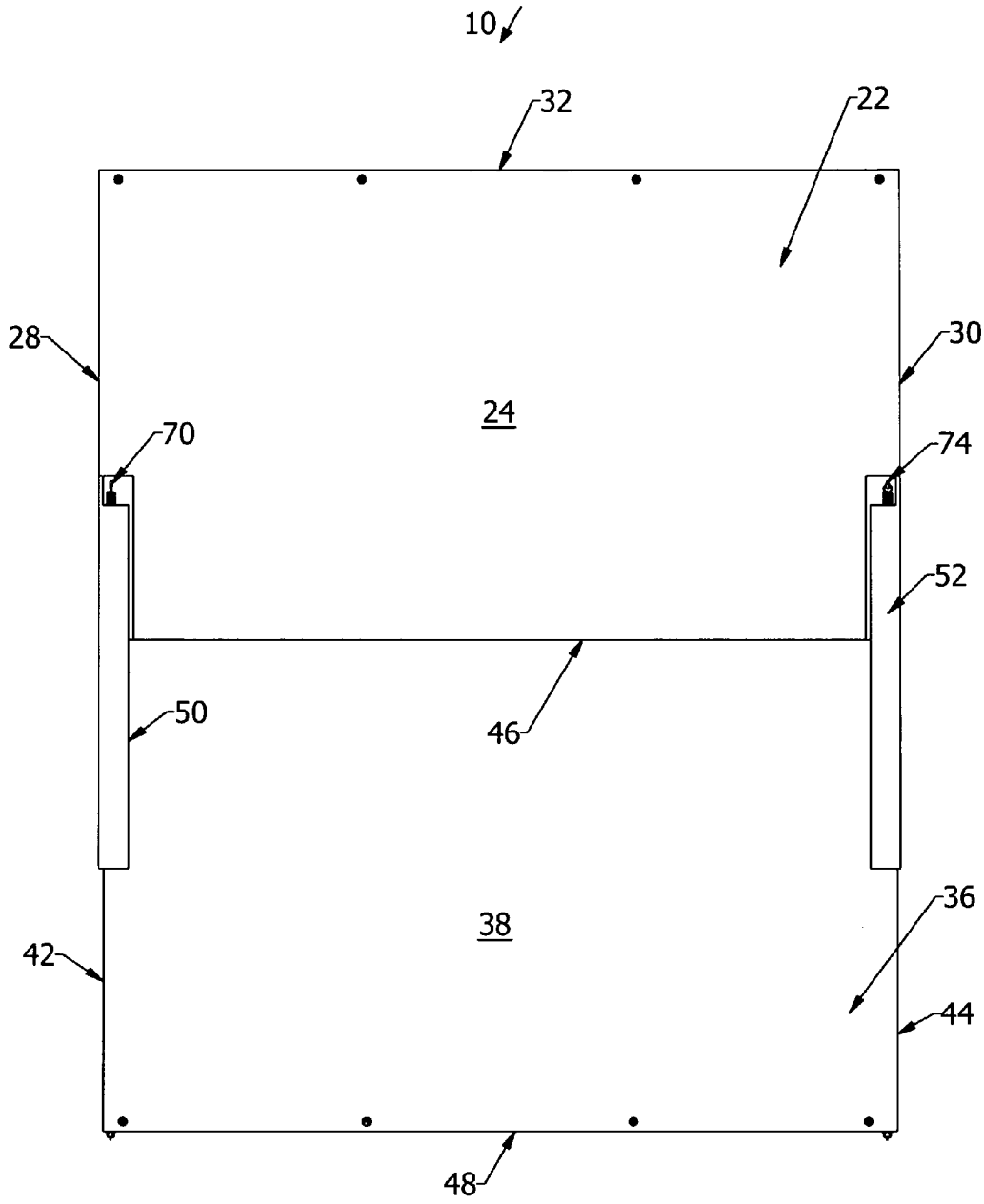
FIG. 1 is a front elevational view illustrating a construction zone sign cover, constructed in accordance with the present invention.
Figure 2:
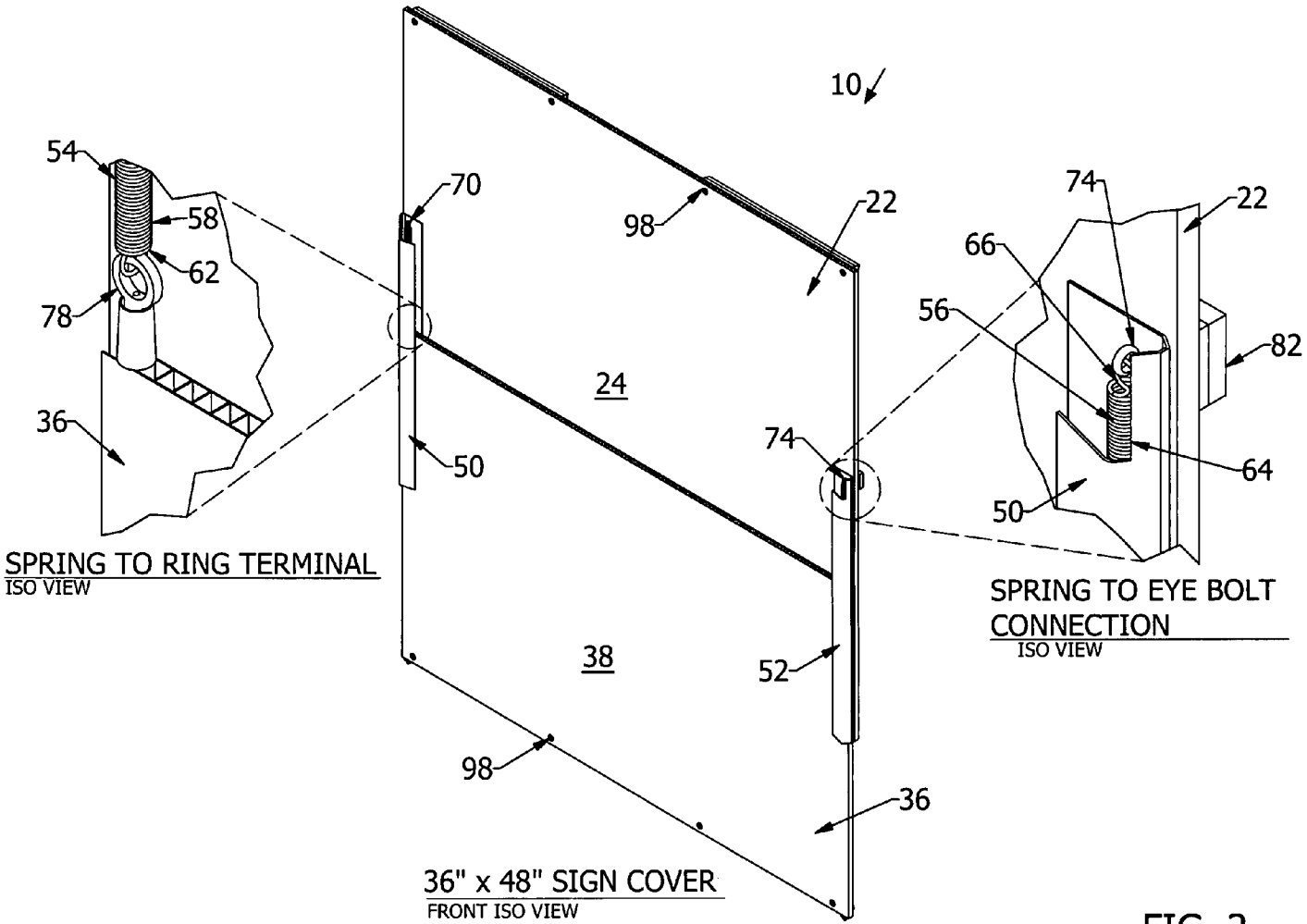
FIG. 2 is an expanded front perspective view illustrating the construction zone sign cover, constructed in accordance with the present invention.
Figure 3:
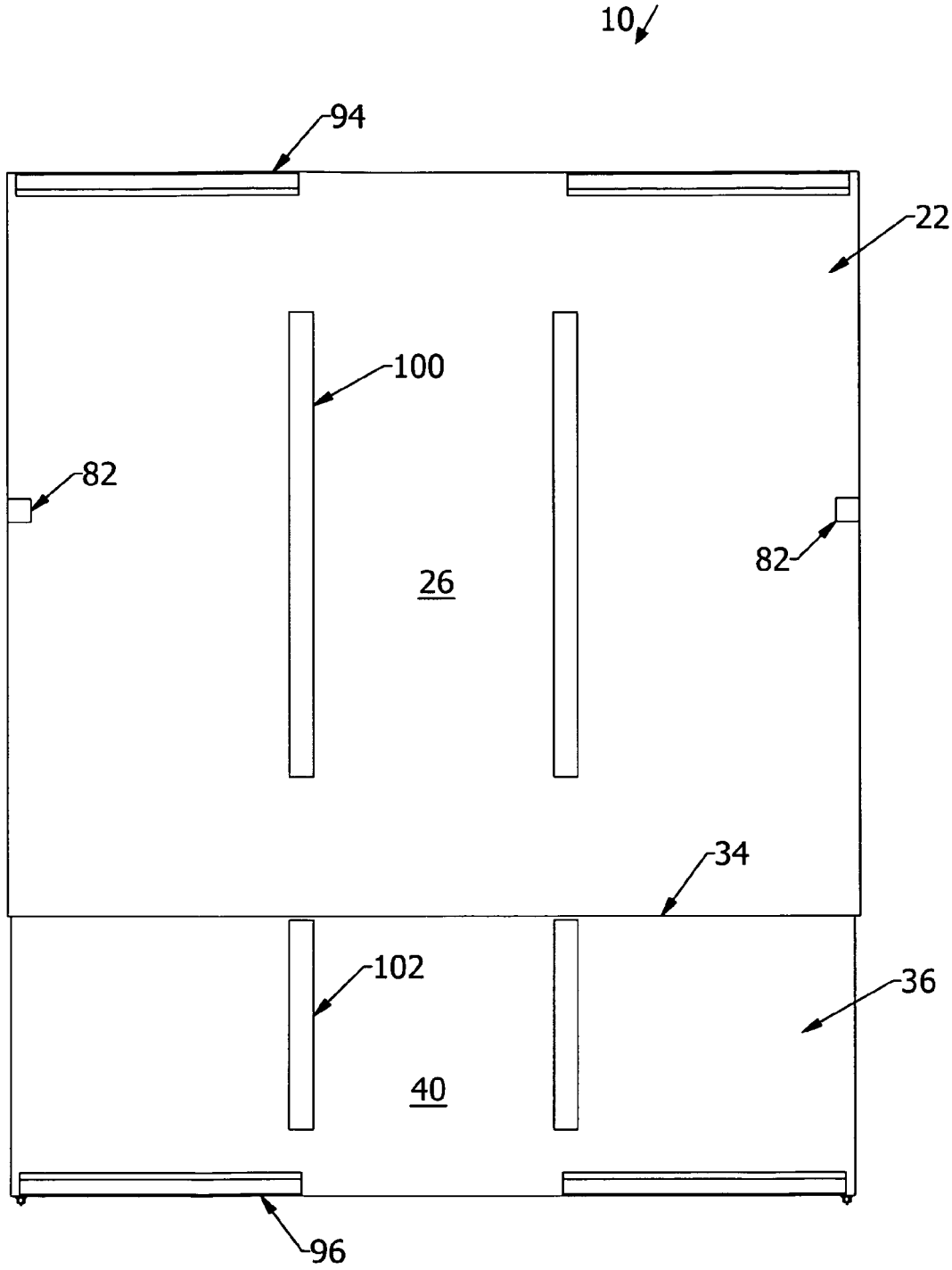
FIG. 3 is a rear elevational view illustrating the construction zone sign cover, constructed in accordance with the present invention.
Figure 4:
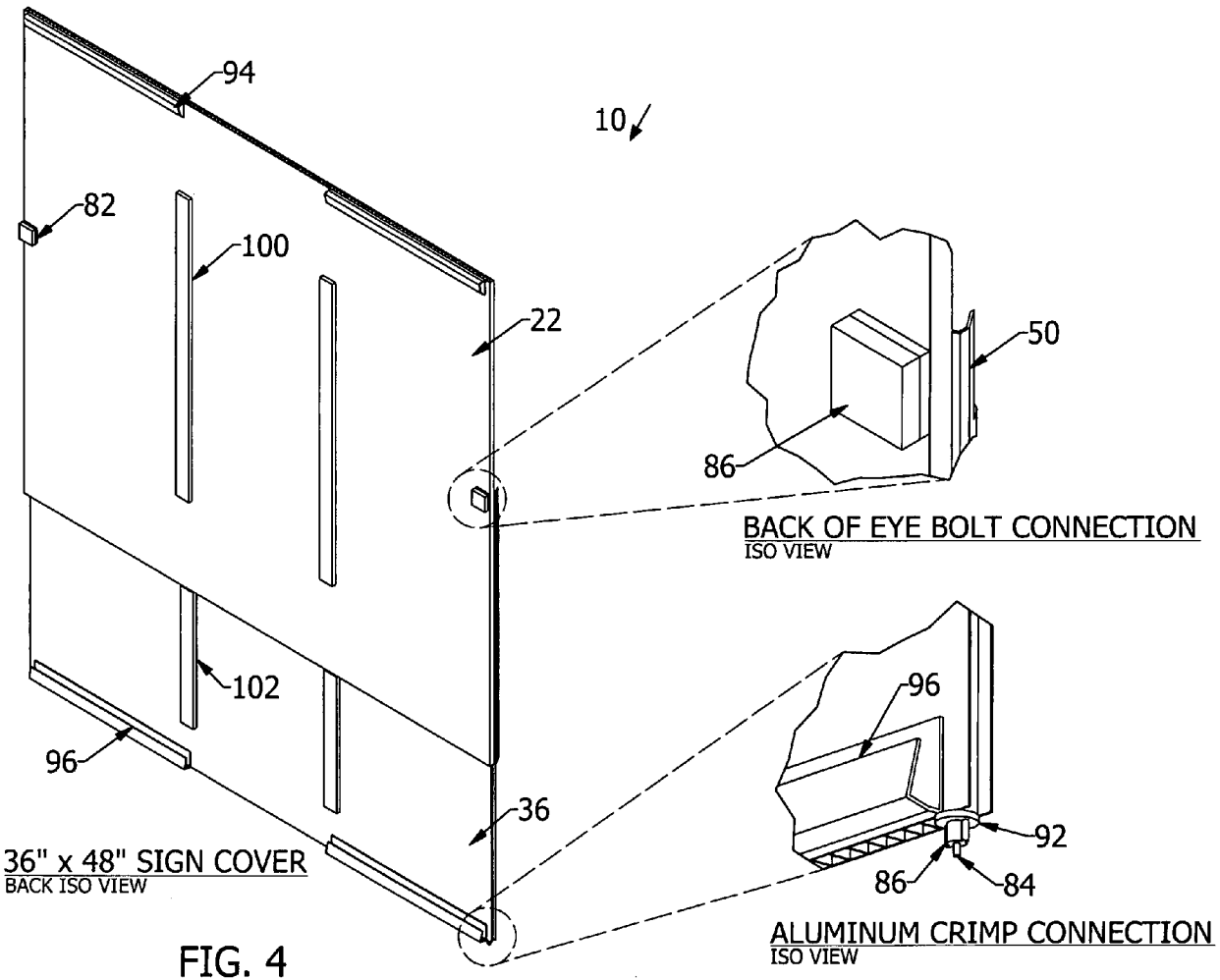
FIG. 4 is an expanded rear perspective view illustrating the construction zone sign cover, constructed in accordance with the present invention.

As illustrated in FIGS. 1-7, the present invention is a construction zone sign cover, indicated generally at 10, for covering highway and/or roadway signs 12 (FIGS. 5 and 7) during construction or other events. Referring now to FIGS. 1-4, the sign 12 typically has a top edge 14, a bottom edge 16, a first side edge 18, and a second side edge 20. The sign cover 10 of the present invention effectively temporarily covers the entire sign 12 during construction and other events.

The sign cover 10 of the present invention further includes a first sign portion 22 having a first side surface 24, a second side surface 26, first side edge 28, a second side edge 30, a top edge 32, and a bottom edge 34 and a second sign portion 36 having a first side surface 38, a second side surface 40, a first side edge 42, a second side edge 44, a top edge 46, and a bottom edge 48. The first sign portion 22 is slidably mounted to the second sign portion 36 with the second side surface 26 of the first sign portion 22 contactingly overlapping the first side surface 38 of the second sign portion 36, the first side edge 28 of the first sign portion 22 aligned with the first side edge 42 of the second sign portion 36, and the second side edge 30 of the first sign portion 22 aligned with the second side edge 44 of the second sign portion 36.

Preferably, the width of the first sign portion 22 is equal to the width of the second sign portion 36 although having a first sign portion 22 and a second sign portion 36 with different widths is within the scope of the present invention. Also, preferably, the length of the first sign portion 22 is equal to the length of the second side portion 36 although having a first sign portion 22 and a second sign portion 36 with different widths is within the scope of the present invention.

Preferably, the first sign portion 22 and the second sign portion 36 of the sign cover 10 of the present invention is constructed from a corrugated plastic material such as Coroplast® plastic sheeting material although constructing the first sign portion 22 and the second sign portion 36 from other durable, lightweight material is within the scope of the present invention.

The sign cover 10 of the present invention further includes a substantially U-shaped first rail 50 mounted to the first side surface 24 of the first sign portion 22 adjacent the first side edge 28 and a substantially U-shaped second rail 52 mounted to the first side surface 24 of the first sign portion 22 adjacent the second side edge 30. Both the first rail 50 and the second rail 52 extend from approximately the bottom edge 34 of the first sign portion 22 to a point approximately halfway between the bottom edge 22 and the top edge 32 of the first sign portion 22. The first side edge 42 of the second sign portion 36 is receivable within the first rail 50 and the second side edge 44 of the second sign portion 36 is receivable within the second rail 52. The first rail 50 and the second rail 52 are preferably secured to the first side surface 24 of the first sign portion 22 via an adhesive material although securing the first side rail 50 and the second side rail 52 in a different manner is within the scope of the present invention.

In an embodiment of the present invention, preferably both the first rail 50 and the second rail 52 have a width of approximately one and one-quarter (1¼") inches although having the first rail 50 and second rail 52 with different dimensions are within the scope of the present invention.

In addition, the sign cover 10 of the present invention includes a first spring mechanism 54 secured between the first sign portion 22 and the second sign portion 36 along the first side edges 28, 42 of the first sign portion 22 and the second sign portion 36. A second spring mechanism 56 is secured between the first sign portion 22 and the second sign portion 36 along the second edges 30, 44 of the first sign portion 22 and the second sign portion 36. The first spring mechanism 54 and the second spring mechanism 56 bias the first sign portion 22 and the second sign portion 36 in a general direction toward each other.

The first spring mechanism 54 includes a first spring 58 having a first end (not shown) and a second end 62 and the second spring mechanism 56 includes a second spring 64 having a first end 66 and a second end (not shown). The first end of the first spring 58 is preferably secured to a first eye bolt 70 threadably secured through first rail 50 and the first sign portion 22 into a first bolt anchor near a top edge of the first rail 50. The first end 66 of the second spring 64 is preferably secured to a second eye bolt 74 threadably secured the second rail 52 and the first sign portion 22 into a second bolt anchor near a top edge of the second rail 52. The second end 62 of the first spring 58 is preferably secured to a first ring terminal 78 extending above the top edge 46 of the second sign portion 36 adjacent the first side edge 42 of the second sign portion 36. The second end of the second spring 64 is preferably secured to a second ring terminal (not shown) extending above the top edge 46 of the second sign portion 36 adjacent the second side edge 44 of the second sign portion 36.

It should be noted that a cushioning material 82 including, but not limited to, foam tape can be positioned over the first bolt anchor and the second bolt anchor to inhibit the first eye bolt 70 and the second eye bolt 74, respectively, from scratching the sign 12 when the sign cover 10 is releasably mounted to the sign 12. Mounting of the sign cover 10 to the sign 12 will be described in further detail below.

The sign cover 10 of the present invention further includes a wire rope 84 extending from the first ring terminal 78 through the second sign portion 36 from the top edge 46 to the bottom edge 48 along the first side edge 42 of the second sign portion 36. As the wire rope 84 exits the bottom edge 48 of the second sign portion 36, the first wire rope 84 is crimped with a first stop 86 positioned outside the bottom edge 48 of the second sign portion 36. Further, the sign cover 10 of the present invention includes the wire rope 84 extending from the second ring terminal through the second sign portion 36 from the top edge 46 to the bottom edge 48 along the second side edge 44 of the second sign portion 36. As the wire rope exits the bottom edge 48 of the second sign portion 36, the wire rope is crimped with a stop 86 positioned outside the bottom edge 48 of the second sign portion 36. A washer 92 can be positioned between the stops 86 and the bottom edge 48 of the second sign portion 36 to inhibit the stops 86 from slipping through the second sign portion 36.

Preferably, the wire ropes 84 of the sign cover 10 of the present invention are one-sixteenths (1/16") inch in diameter although having wire ropes 84 with different dimensions is within the scope of the present invention.

In addition, the sign cover 10 of the present invention has at least one first hanging rail 94 mounted to the second side surface 26 of the first sign portion 22 adjacent the top edge 32 of the first sign portion 22 and at least one second hanging rail 96 mounted to the second side surface 40 of the second sign portion 36 adjacent the bottom edge 48 of the second sign portion 36. In a preferred embodiment, the sign cover 10 has two spaced first hanging rails 94 and two spaced second hanging rails 96 secured to the second side surfaces 26, 40 of the first sign portion 22 and the second sign portion 36, respectively, by rivets 98 or other mounting means. It should be noted that while a particular number of hanging rails 94, 96 secured by a specific mounting means are preferred, it is within the scope of the present invention to have any number of mounting rails 94, 96 secured by any type of mounting means.

Preferably, the first hanging rail 94 and the second hanging rail 96 of the sign cover 10 of the present invention are eight (8 mm) millimeter plastic rails although having the first hanging rail 94 and the second rail 96 being constructed from other sizes of plastic rails is within the scope of the present invention.

The sign cover 10 of the present invention further has a first pair of cushions 100 mounted to the second side surface 26 of the first sign portion 22 and a second pair of cushions 102 mounted to the second side surface 40 of the second sign portion 36. Preferably, the first pair of cushions 100 and the second pair of cushions 102 are foam tape although other types of cushions are within the scope of the present invention. Also, while a pair of cushions mounted to the second side surfaces 26, 40 of the first sign portion 22 and the second sign portion 36, respectively, are described and illustrated herein, it is within the scope of the present invention to have more than a pair of cushions or less than a pair of cushions.

The manner of use of the sign cover 10 of the present invention will now be described. It will be understood by those skilled in the art that the manner of use of the sign cover 10 described herein is merely one method of use and other methods of use of the sign cover 10 are within the scope of the present invention.

Figure 5:
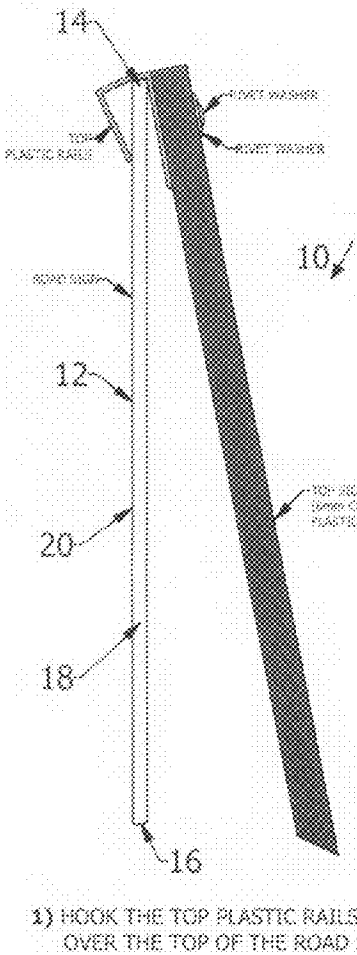
FIG. 5 is an elevational side view illustrating a first step in mounting the construction zone sign cover, constructed in accordance with the present invention, to a sign.
Figure 6:
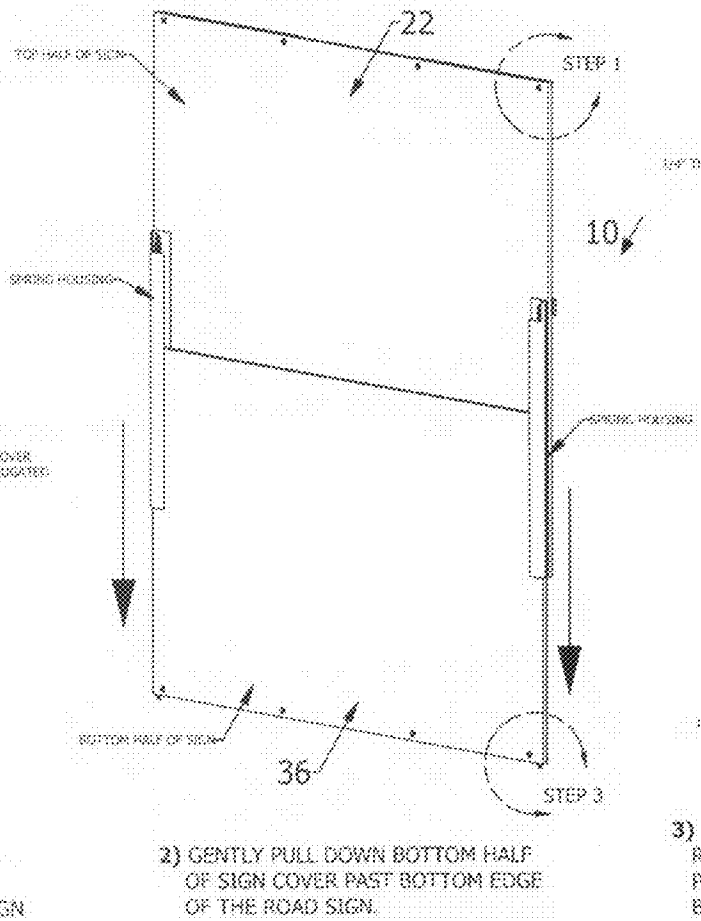
FIG. 6 is a perspective view illustrating a second step in mounting the construction zone sign cover, constructed in accordance with the present invention, to the sign.
Figure 7:
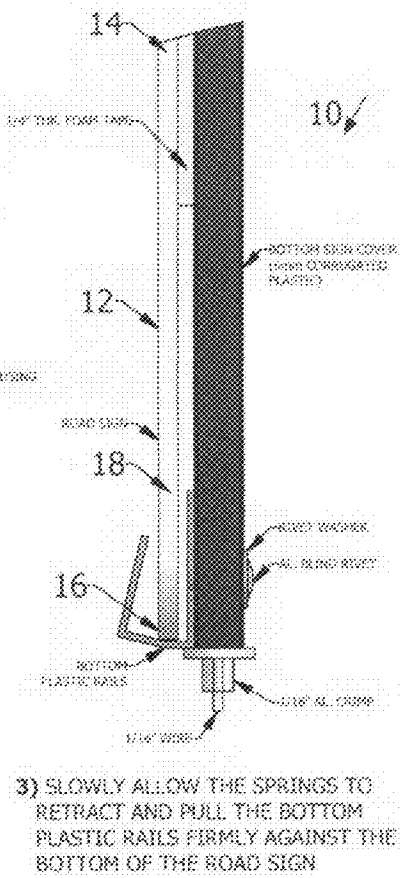
FIG. 7 is an elevational side view illustrating a third step in mounting the construction zone sign cover, constructed in accordance with the present invention, to the sign.

As best illustrated in FIGS. 5-7, to releasably install the sign cover 10 of the present invention on a sign 12, the user simply lifts the lightweight sign cover 10 such that the top edge 14 of the sign 12 is received within the first hanging rails 94 on the first sign portion 22. The second sign portion 36 is then pulled in a generally downward direction, overcoming the bias of the spring mechanisms 54, 56 until the bottom edge 48 of the second sign portion 36 and the second hanging rail 96 is below the bottom edge 16 of the sign 12. Then, the user gently releases the second sign portion 22 until the bottom edge 16 of the sign 12 is received within the second hanging rails 96. The cushioning material 82 and the cushions 100, 102 mounted to the second side surfaces 26, 40 of the first sign portion 22 and the second sign portion 36, respectively, maintain a snug fit between the sign cover 10 and the sign 12. Furthermore, the cushioning material 82 and the cushions 100, 102 maintain the sign cover 10 spaced from the sign 12 protecting the sign 12 from any contact with the first sign portion 22 and the second sign portion 36.

The sign cover 10 of the present invention effectively temporarily covers road signs 12 during construction and other activities. The sign cover 10 is easy and quick to install and remove from the sign 12. Constructed of lightweight, durable material, the sign cover 12 can be reused over and over again.

It should also be noted that while the sign cover 10 of the present invention has been described as being positioned over rectangular or square signs 12, it is within the scope of the present invention to install the sign cover 10 over different types of signs including, but not limited to, diamond, hexagonal, triangular, etc.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A construction zone sign cover for covering a highway and/or roadway sign during construction or other events, the sign having a top edge and a bottom edge, the sign cover comprising:

a first sign portion having a first side surface, a second side surface, first side edge, a second side edge, a top edge, and a bottom edge;

a substantially U-shaped first rail mounted to the first side surface of the first sign portion adjacent the first side edge;

a substantially U-shaped second rail mounted to the first side surface of the first sign portion adjacent the second side edge;

a second sign portion having a first side surface, a second side surface, a first side edge, a second side edge, a top edge, and a bottom edge, the first side edge of the second sign portion receivable within the first rail and the second side edge of the second sign portion receivable within the second rail such that the first sign portion is slidably mounted to the second sign portion with the second side surface of the first sign portion overlapping the first side surface of the second sign portion;

a first spring mechanism secured between the first sign portion and the second sign portion along the first edges of the first sign portion and the second sign portion;

a second spring mechanism secured between the first sign portion and the second sign portion along the second edges of the first sign portion and the second sign portion, the first spring mechanism and the second spring mechanism biasing the first sign portion and the second sign portion in a general direction toward each other;

at least one first hanging rail mounted to the second side surface of the first sign portion adjacent the top edge of the first sign portion, the top edge of the sign releasably receivable within the first hanging rail; and at least one second hanging rail mounted to the second side surface of the second sign portion adjacent the bottom edge of the second sign portion, the bottom edge of the sign releasably receivable within the second hanging rail.

2. The sign cover of claim 1 wherein the first side edge of the first sign portion is aligned with the first side edge of the second sign portion and the second side edge of the first sign portion is aligned with the second side edge of the second sign portion.

3. The sign cover of claim 2 wherein the width of the first sign portion is equal to the width of the second sign portion.

4. The sign cover of claim 1 wherein the first sign portion and the second sign portion are constructed from a corrugated plastic material.

5. The sign cover of claim 1 wherein the first rail and the second rail extend from approximately the bottom edge of the first sign portion to a point approximately halfway between the bottom edge and the top edge of the first sign portion.

6. The sign cover of claim 1 wherein the first rail and the second rail are secured to the first side surface of the first sign portion via an adhesive material.

7. The sign cover of claim 1 wherein the first spring mechanism and the second spring mechanism comprise:

a first spring having a first end and a second end;

a second spring having a first end and a second end;

a first eye bolt threadably secured through first rail and the first sign portion into a first bolt anchor near a top edge of the first rail;

a second eye bolt threadably secured the second rail and the first sign portion into a second bolt anchor near a top edge of the second rail;

a first ring terminal extending above the top edge of the second sign portion adjacent the first side edge of the second sign portion; and a second terminal ring extending above the top edge of the second sign portion adjacent the second side edge of the second sign portion;

wherein the first end of the first spring is secured to the first eye bolt;

wherein the first end of the second spring is secured to the second eye bolt;

wherein the second end of the first spring is secured to the first ring terminal; and wherein the second end of the second spring is secured to the second terminal ring.

8. The sign cover of claim 7 and further comprising:

a first wire rope extending from the first ring terminal through the second sign portion from the top edge to the bottom edge along the first side edge of the second sign portion, the first wire rope exiting the bottom edge of the second sign portion, the first wire rope being crimped with a first stop positioned outside the bottom edge of the second sign portion;

a second wire rope extending from the second ring terminal through the second sign portion from the top edge to the bottom edge along the second side edge of the second sign portion, the second wire rope exiting the bottom edge of the second sign portion, the second wire rope being crimped with a second stop positioned outside the bottom edge of the second sign portion; and a washer positioned between the stops and the bottom edge of the second sign portion inhibiting the stops from slipping through the second sign portion.

9. The sign cover of claim 7 and further comprising:

a cushioning material positioned over the first bolt anchor and the second bolt anchor.

10. The sign cover of claim 1 wherein the sign cover has two spaced first hanging rails and two spaced second hanging rails secured to the second side surfaces of the first sign portion and the second sign portion.

11. The sign cover of claim 1 and further comprising:

a first pair of cushions mounted to the second side surface of the first sign portion; and a second pair of cushions mounted to the second side surface of the second sign portion.

12. A construction zone sign cover for covering a highway and/or roadway sign during construction or other events, the sign having a top edge and a bottom edge, the sign cover comprising:

a first sign portion having a first side surface, a second side surface, first side edge, a second side edge, a top edge, and a bottom edge;

a second sign portion having a first side surface, a second side surface, a first side edge, a second side edge, a top edge, and a bottom edge;

connecting means for slidably connecting the first sign portion to the second sign portion;

biasing means for biasing the first sign portion and the second sign portion in a general direction toward each other;

first securing means for releasably securing the top edge of the first sign portion to the top edge of the sign; and second securing means for releasably securing the bottom edge of the second sign portion to the bottom edge of the sign.

13. The sign cover of claim 12 wherein the connecting means includes a substantially U-shaped first rail mounted to the first side surface of the first sign portion adjacent the first side edge and a substantially U-shaped second rail mounted to the first side surface of the first sign portion adjacent the second side edge, wherein the first side edge of the second sign portion is receivable within the first rail and the second side edge of the second sign portion receivable within the second rail such that the first sign portion is slidably mounted to the second sign portion with the second side surface of the first sign portion overlapping the first side surface of the second sign portion.

14. The sign cover of claim 12 wherein the biasing means includes a first spring mechanism secured between the first sign portion and the second sign portion along the first edges of the first sign portion and the second sign portion and a second spring mechanism secured between the first sign portion and the second sign portion along the second edges of the first sign portion and the second sign portion, the first spring mechanism and the second spring mechanism biasing the first sign portion and the second sign portion in a general direction toward each other.

15. The sign cover of claim 12 wherein the first securing means includes at least one first hanging rail mounted to the second side surface of the first sign portion adjacent the top edge of the first sign portion with the top edge of the sign receivable within the first hanging rail and at least one second hanging rail mounted to the second side surface of the second sign portion adjacent the bottom edge of the second sign portion with the bottom edge of the sign receivable within the second hanging rail.

16. The sign cover of claim 12 and further comprising:

a first pair of cushions mounted to the second side surface of the first sign portion; and a second pair of cushions mounted to the second side surface of the second sign portion.

17. A method for covering a highway and/or roadway sign during construction or other events, the sign having a top edge and a bottom edge, the method comprising:

providing a first sign portion having a first side surface, a second side surface, first side edge, a second side edge, a top edge, and a bottom edge;

providing a second sign portion having a first side surface, a second side surface, a first side edge, a second side edge, a top edge, and a bottom edge;

slidably connecting the first sign portion to the second sign portion;

biasing the first sign portion and the second sign portion in a general direction toward each other;

releasably securing the top edge of the first sign portion to the top edge of the sign; and releasably securing the bottom edge of the second sign portion to the bottom edge of the sign.

18. The method of claim 17 and further comprising:

mounting a substantially U-shaped first rail to the first side surface of the first sign portion adjacent the first side edge;

mounting a substantially U-shaped second rail to the first side surface of the first sign portion adjacent the second side edge;

positioning the first side edge of the second sign portion within the first rail; and positioning the second side edge of the second sign portion within the second rail.

19. The method of claim 17 and further comprising:

securing a first spring mechanism between the first sign portion and the second sign portion along the first edges of the first sign portion and the second sign portion; and securing a second spring mechanism between the first sign portion and the second sign portion along the second edges of the first sign portion and the second sign portion.

20. The method of claim 17 and further comprising:

mounting at least one first hanging rail to the second side surface of the first sign portion adjacent the top edge of the first sign portion;

mounting at least one second hanging rail to the second side surface of the second sign portion adjacent the bottom edge of the second sign portion.

* * * * *